United States Patent [19]

Tupitsyn et al.

[11] Patent Number: 4,690,225

[45] Date of Patent: Sep. 1, 1987

[54] PERCUSSIVE TOOL

[75] Inventors: Konstantin K. Tupitsyn; Sergei K. Tupitsyn; Alexandr D. Kostylev; Veniamin V. Kamensky; Sergei A. Chufistov, all of Novosibirsk, U.S.S.R.

[73] Assignee: Institut Gornogo Dela Sibirskogo Otdelenia Akademii Nauk SSSR, Novosibirsk, U.S.S.R.

[21] Appl. No.: 777,880

[22] Filed: Sep. 20, 1985

Related U.S. Application Data

[63] Continuation of Ser. No. 413,891, Sep. 1, 1982, abandoned.

[30] Foreign Application Priority Data

May 14, 1979 [SU] U.S.S.R. ..... 2765328

[51] Int. Cl.[4] ..... B25D 9/02

[52] U.S. Cl. ..... 173/116; 173/14; 173/91; 60/593

[58] Field of Search ..... 173/14–17, 173/91, 92, 116, 134–138, 90, 119, 121; 91/5; 60/542, 580, 584, 591, 593; 92/134

[56] References Cited

U.S. PATENT DOCUMENTS

| | | | |
|---|---|---|---|
| 152,391 | 6/1874 | Manson | 173/14 |
| 542,498 | 7/1895 | Rinsche | 173/136 |
| 787,960 | 4/1905 | Temple | 60/542 |
| 805,197 | 11/1905 | Gibson | 60/542 |
| 969,354 | 9/1910 | Felumlee | 173/116 |
| 1,959,458 | 5/1934 | Christiensen | 173/116 |
| 2,168,806 | 3/1939 | Reilly | 60/54.5 |
| 2,638,749 | 5/1953 | Sparano | 173/116 |
| 3,638,423 | 1/1972 | Van Heijst | 92/134 X |
| 3,651,874 | 3/1972 | Sudnishnikov et al. | 173/91 |
| 3,696,709 | 10/1972 | Schmidlin | 173/135 |
| 3,821,992 | 6/1974 | Matsuo | 60/593 |
| 3,974,885 | 8/1976 | Sudnishnikov et al. | 173/121 |

FOREIGN PATENT DOCUMENTS

| | | | |
|---|---|---|---|
| 134369 | 10/1901 | Fed. Rep. of Germany . | |
| 282910 | 4/1914 | Fed. Rep. of Germany | 173/116 |
| 374365 | 10/1920 | Fed. Rep. of Germany . | |
| 401886 | 10/1920 | Fed. Rep. of Germany . | |
| 1068638 | 4/1960 | Fed. Rep. of Germany . | |
| 1132067 | 6/1962 | Fed. Rep. of Germany . | |
| 1628059 | 12/1970 | Fed. Rep. of Germany . | |
| 1628057 | 3/1973 | Fed. Rep. of Germany . | |
| 1533682 | 6/1975 | Fed. Rep. of Germany . | |
| 2450560 | 5/1976 | Fed. Rep. of Germany . | |
| 2850225 | 6/1980 | Fed. Rep. of Germany . | |
| 2046372 | 3/1971 | France . | |
| 2326543 | 5/1979 | France . | |
| 2399305 | 3/1980 | France . | |
| 2418306 | 10/1980 | France . | |
| 952403 | 3/1964 | United Kingdom . | |
| 1361552 | 7/1974 | United Kingdom . | |
| 2006654 | 5/1979 | United Kingdom . | |
| 443752 | 4/1975 | U.S.S.R. | 173/137 |

OTHER PUBLICATIONS

USSR–"Hand Power Tools" by Sudaleovitch et al, pp. 170, 171, with translation.

*Primary Examiner*—E. R. Kazenske
*Assistant Examiner*—James L. Wolfe
*Attorney, Agent, or Firm*—Fleit, Jacobson, Cohn & Price

[57] ABSTRACT

A percussive tool comprises a percussion mechanism and a pressure pulser. The percussion mechanism has a hollow housing with a piston hammer arranged thereinside to form two chambers of variable volume. The pressure pulser has a hollow housing and a fluid displacer defining inside the housing a working chamber adapted to alternately communicate with a source of gaseous fluid and the interior of the percussion mechanism. The fluid displacer is intended for forced displacement inside the housing to transmit to the chambers of the percussion mechanism a pulsed pressure of the gaseous fluid which causes the piston hammer to reciprocate. The interior of the percussion mechanism is isolated from the outside, whereas the working chamber of the pressure pulser communicates with at least one of the chambers of the percussion mechanism, the chambers of the percussion mechanism continuously intercommunicating by way of a restrictor passage.

8 Claims, 7 Drawing Figures

PERCUSSIVE TOOL

This application is a continuation of application Ser. No. 413,891, filed Sept. 1, 1982, now abandoned.

FIELD OF THE INVENTION

This invention relates to construction and mining machinery, and more particularly to percussive tools.

The invention can find application in machines for driving piles and tubes into the ground.

The invention can further be applied in self-propelled machines for drilling holes in the soils being compacted and in machines for deep-well compacting of soils.

Another possible use of the invention includes mounted machines for impact-breaking various materials.

The invention can also be made use of in hand-held percussive tools of various designations, as well as in soil compactors and vibrators.

The invention can be applied most advantageously in percussive tools intended for operation in loose materials and underwater.

BACKGROUND OF THE INVENTION

There is known a percussive tool comprising a percussion mechanism and a pressure pulser. The percussion mechanism has a hollow housing provided with a working implement. The interior of the housing accommodates for reciprocations therein a piston hammer separating the interior into two chambers of variable volume, particularly a front chamber defined by the working implement, piston hammer and the walls of the housing, and a rear chamber formed by the piston hammer and the walls of the housing. The front chamber continuously communicates with the outside by way of a port made in the housing. A side wall of the housing has an exhaust port provided with a non-return valve, which, depending on the position of the piston hammer may be either blocked by the side surface of the piston hammer or open when the piston hammer contacts the working implement. The non-return valve does not prevent the escape of air from the rear chamber to the outside and blocks the passage of air from the outside into this chamber. The pressure pulser comprises a hollow cylindrical housing having arranged in the interior thereof a fluid displacer in the form of a piston adapted for effecting forced reciprocations therein and forming together with the walls of the housing a working chamber of variable volume, which chamber continuously communicates via a flexible hosepipe with the rear chamber of the percussion mechanism. Arranged in the housing of the pressure pulser is a port for feeding to the working chamber the outside air. This port may, depending on the position of the fluid displacer in the course of forced reciprocations thereof, be either blocked by the side surface of the fluid displacer or it may be open. In order to impart reciprocations to the fluid displacer, the percussive tool has a drive means and a crank mechanism.

When the drive means is engaged, it acts to impart reciprocations through the crank mechanism to the fluid displacer whereby the volume of the working chamber varies according to a certain periodicity. This in turn results in that the rear chamber of the percussion mechanism is subjected to alternating compressions and expansions thanks to the provision of the flexible hosepipe which continuously communicates the rear chamber of the percussion mechanism with the working chamber of the pressure pulser. Pressure in the front chamber of the percussion mechanism is maintained constant and equal to the outside (atmospheric) pressure due to the fact that this chamber continuously communicates with the outside via the port. The piston hammer is caused to move toward the working implement, that is to effect a work stroke, under the action of excess pressure in the rear chamber of the percussion mechanism. When the piston hammer approaches the working implement, or before the piston hammer strikes against the working implement, the exhaust port opens resulting in a pressure drop in this chamber. Subsequent to the collision of the piston hammer with the working implement, an underpressure is produced in the working chamber of the pressure pulser and consequently in the rear chamber of the percussion mechanism. At this instance the outside (atmospheric) pressure prevails over the pressure in the rear chamber which acts to close the non-return valve, while the piston hammer is caused to move in the opposite direction. A further movement of the piston hammer in the opposite direction is decelerated to a complete stop by virtue of an increase in pressure in the rear chamber when the air contained in this chamber is compressed. The air which escapes through the exhaust port after the work stroke is compensated for by a fresh flow sucked in through the port arranged in the housing of the pressure pulser. Thereafter, the heretofore described cycle is recommenced.

Inherent in the above machine is a disadvantage residing in its low specific power, that is the power per unit volume occupied by the percussive tool. This is explained by the fact that the pressure differential between the front and rear chambers of the percussion mechanism is rather small in value. More specifically, it is never in excess of between 0.03 and 0.04 MPa during the return stroke of the piston hammer.

Another disadvantage is that the front chamber of the percussion mechanism is continuously open on the outside and is therefore susceptible to penetration thereinto of foreign, particularly abrasive, particles resulting in excessive wear of parts which may lead to jamming of the piston hammer.

One more disadvantage is the noise caused by the exhaust of compressed air from the rear chamber of the percussion mechanism.

Yet another disadvantage which limits the application of the above percussive tool is that it is usable exclusively in the air medium. Operation of the machine in a loose material or underwater is inherently impossible.

In addition, the machine cannot be adapted for use as a self-propelled withdrawable percussive tool for drilling holes in soils being compacted, since there is no provision for changing the direction of impacts delivered by the piston hammer.

SUMMARY OF THE INVENTION

It is therefore an object of this invention to provide a percussive tool of higher specific power and efficiency.

Another object is to extend the range of application of the percussive tool, particularly to make the tool operable in a loose material and underwater, as well as to make the percussive tool automatically withdrawable when used for deep-well compacting of soils or blind-hole sinking.

Yet another object is to reduce the noise produced by the percussive tool during operation.

One more object is to improve the reliability of the percussive tool.

These objects are attained by that in a percussive tool comprising a percussion mechanism having a working implement, a hollow housing accommodating for reciprocations therein a piston hammer which separates the interior of the housing into two chambers of variable volume, and a pressure pulser having a hollow housing accommodating a fluid displacer forming with the walls of the housing a working chamber adapted to alternately communicate with a source of gaseous fluid and the interior of the percussion mechanism and intended for forced displacement inside the housing accompanied by a periodic forced variations in the volume of the working chamber to transmit to the chambers of the percussion mechanism a pulsed pressure of the gaseous fluid which acts to reciprocate the piston hammer whereby the working implement is subjected to percussions, according to the invention, the interior of the housing of the percussion mechanism in isolated from the outside, whereas the working chamber of the pressure pulser communicates with at least one of the chambers of the percussion mechanism, these chambers being adapted to continuously intercommunicate by way of a restrictor passage.

Such an arrangement made it possible to produce a high pressure in any of the chambers of the percussion mechanism exceeding severalfold the pressure of the outside medium. In other words, the required pressure in the two chambers of the percussion mechanism is set by the parameters of the pressure pulser and not by the outside pressure. It stands to reason that an increase in pressure in the chambers of the percussion mechanism will result in greater specific power of the percussive tool in proportion to the increase in pressure.

Also, the isolation of the both chambers of the percussion mechanism from the outside prevents the penetration of foreign, especially abrasive, particles thereinto. This enables the percussion mechanism to operate in practically any medium, be it liquid (underwater) or loose, etc.

Another advantageous result of isolating the chambers of the percussion mechanism from the outside is the absence of exhaust, which completely eliminates the aerodynamic component of noise produced by the machine during operation.

Preferably, the passage which continuously intercommunicates the chambers of the percussion mechanism is arranged in the body of the piston hammer.

Alternatively, this passage may be arranged in the housing of the percussion mechanism, which guarantees its normal functioning.

Advisably, the passage intercommunicating the chambers of the percussion mechanism is fashioned as a gap between the piston hammer and the walls of the housing. This arrangement of the passage also provides for its normal functioning and is less costly in manufacture.

Preferably, the working chamber of the pressure pulser is communicated with a receiver in the form of a closed chamber the volume of which is commensurable with the volume of the working chamber, the receiver being provided with a means for engaging it with and disengaging it from the working chamber.

The above arrangement makes it possible to vary one of the most important parameters of the pressure pulser, viz. the volume of its working chamber. The volume of this chamber in turn affects the value of pressure produced during compression and expansion. In consequence, by engaging the receiver with or disengaging it from the working chamber the operator is capable at his will to set one of the two alternative variations of pressure changes in the chambers of the percussive tool during operation, which in the end determines the movement of the piston hammer. As a result, it becomes possible to set one of the two operating modes of the percussive tool which differ by the direction of impacts delivered by the piston hammer under the acton of pressure in the chambers.

Preferably, the working chamber of the pressure pulser is adapted to alternately communicate with a source of pressurized gaseous fluid. This enables to further increase the forces causing the piston hammer of the percussion mechanism to move, the value of these forces being proportional to the pressure in the source of gaseous fluid. As a result, other conditions being equal (dimensions of the percussive tool, number of cycles per unit time, etc.), the energy of each impact will grow in proportion with the pressure in the source of gaseous fluid, i.e. the specific power of the percussive tool will grow.

Advisably, the working chamber of the pressure pulser is adapted to communicate with the source of gaseous fluid via a check valve to provide for a one-way passage of the gaseous fluid into the working chamber.

Such an arrangement allows to increase the mean pressure in the chambers of the percussion mechanism relative to the pressure in the source of gaseous fluid thereby resulting in an increase in the specific power of the percussive tool.

Preferably, at least one of the chambers of the percussion mechanism communicates with the working chamber of the pressure pulser, this working chamber being the interior of a cylinder closed on the two sides, the interior accommodating the fluid displacer in the form of a piston separating the interior of the cylinder into the working chamber per se and a discharge chamber, each of the chambers communicating with the source of pressurized gaseous fluid.

The above arrangement will lead to that pressure in the discharge chamber of the pressure pulser which acts upon the fluid displacer (piston) also acts to reduce the resultant of the pressure forces applied to the fluid displacer (piston) to thereby bring down the maximum loads exerted on the transmission of the fluid displacer (piston) and the drive means thereof.

BRIEF DESCRIPTION OF THE DRAWINGS

The invention will now be described in greater detail with reference to specific embodiments thereof taken in conjunction with the accompanying drawings in which.

DETAILED DESCRIPTION OF THE INVENTION

Figure 1:
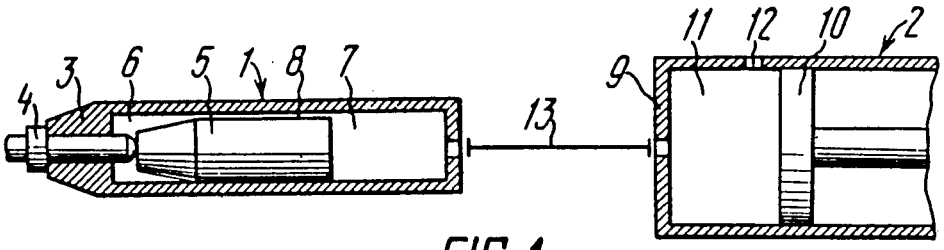
FIG. 1 is a schematic illustration of a percussive tool according to the invention.

With reference to FIG. 1, a percussive tool according to the invention comprises a percussion mechanism 1 and a pressure pulser 2. The percussion mechanism 1 has a hollow cylindrical housing 3 provided with an implement 4 and positioned inside the housing 3 for reciprocation therein is a piston hammer 5 separating the interior of the housing into two closed chambers of variable volume, particularly a front chamber 6 and a rear chamber 7. The chambers 6 and 7 are adapted to continuously intercommunicate by way of a restrictor passage 8 in the form of a gap between the piston hammer 5 and the housing 3. The pressure pulser 2 in this particular modification is fashioned as a hollow cylindrical housing 9 having arranged in the interior thereof a fluid displacer 10 in the form of a piston adapted to be forcefully reciprocated inside the housing 9 and defining with the housing 9 a closed chamber 11 of variable volume.

A port 12 is provided in the side wall of the housing 9 of the pressure pulser 2 for feeding a gaseous fluid into the working chamber 11, the port 12 may be either open or blocked by the side surface of the fluid displacer 10. The working chamber 11 continuously communicates with the rear chamber 7 of the percussion mechanism by means of a flexible hosepipe 13. The forced movement of the displacer 10 is effected by a drive means (not shown), such as an electric motor, or an internal combustion engine, or a power-take-off shaft and the like, having a power transmission mechanism in the form of a crank, rocker arm or cam, etc.

The housing 9 of the pressure pulser 2 may not necessarily be cylindrical, while the fluid displacer 10 may be fashioned otherwise than in the form of a piston. The crosssectional configuration of the housing 9 and the fluid displacer 10 may, for example, be rectangular or it may have any other suitable shape.

Likewise, the pressure pulser 2 may be embodied in a different manner, for example, it may be fashioned as a linear electric motor. In this case the function of the fluid displacer may be taken over by the armature of the motor, the armature being capable to reciprocate under the action of electromagnetic forces inside the stator to form therewith a working chamber of variable volume in continuous communication with one of the chambers of the percussion mechanism by means of a flexible hosepipe. The stator of the linear electric motor must also be provided with a port to feed a gaseous fluid into the working chamber, the port may be open or blocked by the side surface of the armature depending on the position of the armature.

Alternatively, other modified forms of the pressure pulser 2 are possible to effect the above described functions.

The restrictor passage 8 which intercommunicates the chambers 6 and 7 of the percussion mechanism may be arranged in the body of the piston hammer 5 or in the housing 3 without affecting the operating principle of the percussive tool according to the invention.

If desired, the working implement 4 may form a one-piece construction with the housing 3 of the percussion mechanism 1. In this case the housing 3 performs the functions of the implement 4. The integrated arrangement of the implement 4 and the housing 3 is very often made use of in self-propelled percussive machines for drilling holes in soils being compacted, wherein the housing of such a machine executes the function of the working implement.

The percussive tool shown schematically in FIG. 1 operates as follows.

Engagement of the drive means causes the fluid displacer 10 of the pressure pulser 2 to reciprocate in a periodic manner. Therewith, the pressure of the gaseous fluid or air in the chamber 11 and, consequently, in the rear chamber 7 continuously communicated with the chamber 11 via the hosepipe 13, is likewise changed in a periodic manner, the period being equal to the period of movement of the fluid displacer 10. Because the chambers 6 and 7 of the percussion mechanism are in communication through the restrictor passage 8, the value of pressures in these chambers is not equal. Under the action of the periodically changing pressure differentials in the chambers 6 and 7 of the percussion mechanism, the piston hammer 5 is caused to periodically reciprocate and strike the implement 4. The inevitable leaks of air from the working chamber 11 of the pressure pulser 11 are automatically compensated thanks to the admission of compressed air through the port 12 in the housing 9 of the pulser.

High operating performance of the percussive tool according to the invention may only be ensured if definite combinations of basic structural parameters are maintained. Among these are:

- mass and cross-sectional area of the piston hammer;
- cross-section of the passage 8 communicating the chambers 6 and 7 of the percussion mechanism;
- volumes of the chambers 6 and 7 at extreme positions of the piston hammer 5;
- length and inner flow section of the hosepipe 13;
- effective area of the fluid displacer 10;
- amplitude and frequency of reciprocations of the fluid displacer 10;
- position of the port 12 in the side wall of the housing 9 of the pulser 2; and
- pressure of the gaseous fluid fed into the working chamber 11 of the pressure pulser 2.

A proper choice of the above parameters will result in that the mean pressure in the front chamber 6 of the percussion mechanism, as well as that in the rear chamber 7, will considerably prevail over the outside pressure. Concurrently, the pressure differential between these chambers will also greatly (severalfold) prevail over the outside pressure both during the work and return strokes of the piston hammer 5.

A modification of the percussive tool according to the invention wherein the pressure pulser is not cylindrical in shape, or wherein the pressure pulser is made integral with a linear electric motor operates in essentially the same manner.

The percussive tool embodying the present invention is comprised of the aforedescribed inherently and inseparably linked devices, particularly the percussion mechanism 1 and the pressure pulser 2. The percussion mechanism 1 cannot operate without the pressure pulser 2. Therefore, modifications of the percussive tool to be described hereinbelow are operable by virtue of the fact that the percussion mechanism 1 is isolated from the outside medium, while the chambers 6 and 7 therefore are intercommunicating through the restrictor passage. This arrangement of the percussive tool allows to eliminate discharge of the gaseous fluid into the atmosphere and make a multiple use of the portion of the gaseous fluid contained in the tool as a means for transferring the energy while compensating for negligible losses or leaks of this fluid into the atmosphere. Another advantageous feature of the percussive tool according to the invention resides in that it can operate at a much higher pressure of the gaseous fluid. This affords not only to raise the specific power and efficiency of the percussive tool, but also to make it operable irrespective of the surrounding media; otherwise stated, the percussive tool embodying the invention is capable to operate underwater, in a loose material, etc. Further, noise in operation is greatly reduced due to the lack of exhaust.

Figure 2:
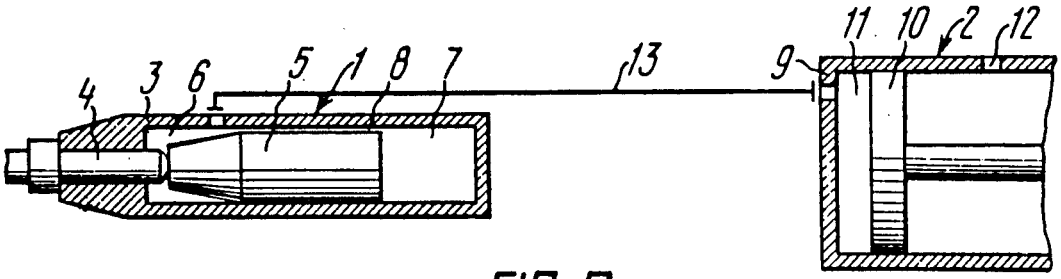
FIG. 2 shows schematically a modified form of the percussive tool embodying the present invention wherein a working chamber of a pressure pulser communicates with a front chamber of a percussion mechanism.

Referring now to FIG. 2, there is shown another modified form of the percussive tool according to the invention which differs from the machine of FIG. 1 solely in that the working chamber 11 of the pulser is continuously communicated with the front chamber 6 of the percussion mechanism in contrast to the tool of FIG. 1 wherein it communicates with the rear chamber 7.

The machine of FIG. 2 operates substantially in the same manner as the one illustrated in FIG. 1. Under the action of a periodically varying pressure differential in the chambers 6 and 7 of the percussion mechanism 1, the piston hammer 5 is caused to reciprocate and strike against the working implement 4. However, the above described construction of the machine makes it possible to reduce the dimensions of the pressure pulser 2.

Figure 3:
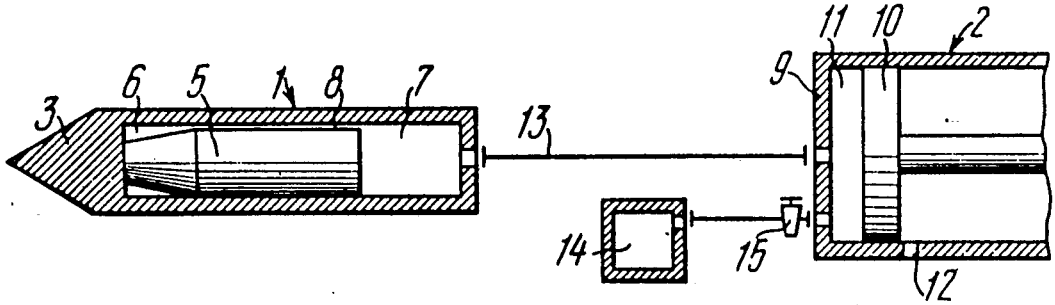
FIG. 3 shows another modification of the percussive tool according to the invention provided with a receiver in the form of a closed chamber, and a means for engaging the receiver with and disengaging it from the working chamber of the pressure pulser.
Figure 1A:
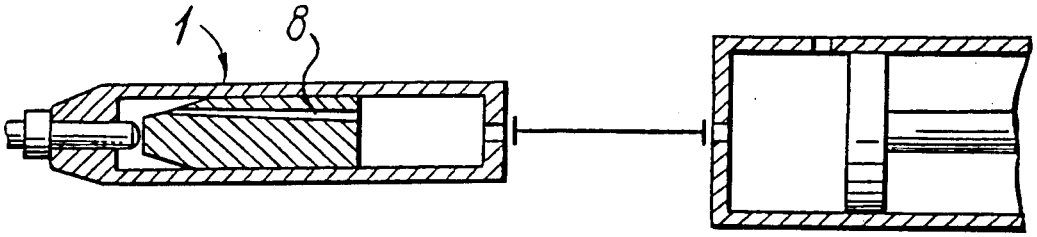
FIGS. 1*a* and 1*b* show further embodiments of the percussive tool of FIG. 1.
Figure 1B:
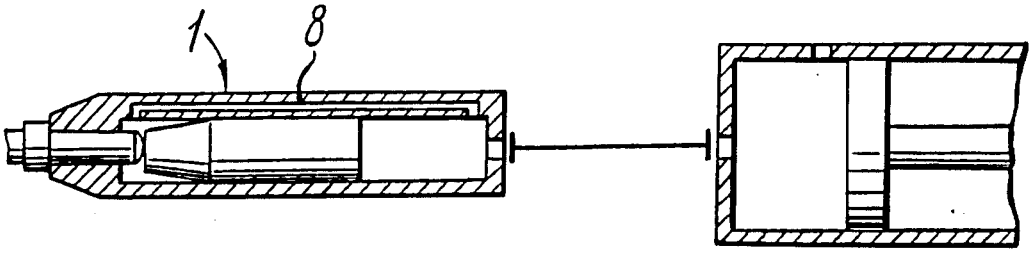

With reference to FIG. 3, a modified form of the percussive tool according to the invention illustrated therein differs in a number of respects from the modifications shown in FIGS. 1 and 2. More specifically, it is provided with a receiver 14 in the form of a closed chamber the volume of which is commensurate with the volume of the working chamber 11 of the pressure pulser 2, and a means 15 for engaging the receiver 14 with and disengaging it from the working chamber 11 of the pulser 2. The means 15 may be fashioned as a gate valve or slide valve, etc. Another difference is that the housing 3 of the percussion mechanism 1 is made integral with the working implement, that is the housing functions as the implement.

When the means 15 is shut the percussive tool operates substantially as described with reference to the modification illustrated in FIG. 1. Because the function of the working implement in this modification is taken over the housing 3 of the percussion mechanism, the piston hammer 5 strikes against the front part of the housing. Under the action of impacts from the piston hammer the housing 3 is driven into the ground leaving behind a well with compacted walls. To withdraw the percussion mechanism 1 from the well, the receiver 14 is engaged with the working chamber 11 of the pressure pulser 11 thereby changing one major parameter of the pulser, particularly the volume of its working chamber. In this case reciprocations of the piston hammer 5 result in that the piston hammer strikes the rear of the housing 3 causing the percussion mechanism 1 to retract along the well.

Therefore, by changing only one of the parameters of the pressure pulser, viz, the volume of the working chamber 11, it becomes possible to change the direction of impacts delivered by the piston hammer 5. However, as has been stated above, parameters affecting operation of the percussive tool are at least four in number, which means that the direction of impacts delivered by the piston hammer may be varied by changing some other parameter, for example, the position of the port 12 intended for feeding the gaseous fluid into the pulser. To this end, it is sufficient to provide in the housing 9 of the pressure pulser an additional port for feeding the gaseous fluid into the chamber 11 offset forward of the port 12, that is in the direction in which the fluid displacer 10 moves when the air in the working chamber 11 is compressed, and further to employ a means, such as a valve, for communicating the port with and discommunicating it from the source of gaseous fluid. With the valve in a closed position the piston hammer 5 delivers impacts in one direction, while in an open position it strikes in the opposite direction.

Figure 4:
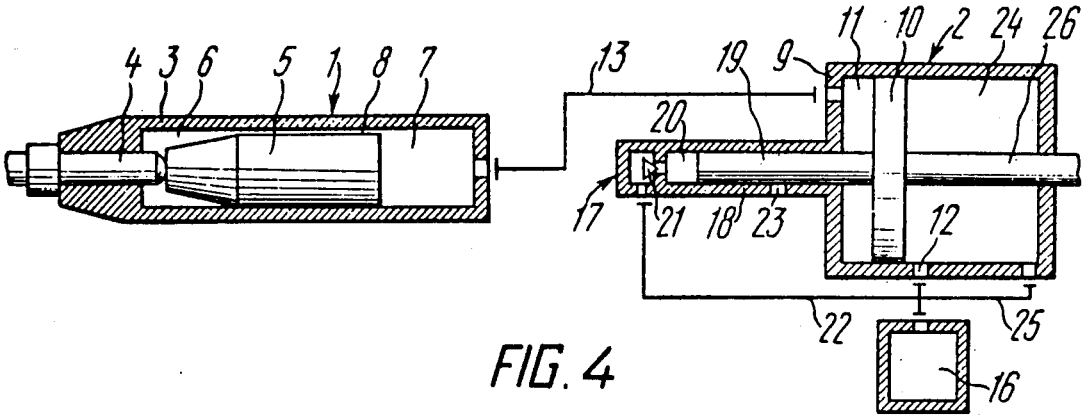
FIG. 4 is yet another modification of the percussive tool according to the invention provided with a source of pressurized gaseous fluid in communication with the working and discharge chambers of the pressure pulser, and a means for maintaining pressure in the source of the gaseous fluid.

Referring now to FIG. 4, a modified form of the percussive tool according to the invention is provided with a high pressure source of the gaseous fluid in the form of a receiver 16 capable of communicating via the port 12 in the housing 9 with the working chamber 11 of the pressure pulser 2. To maintain high pressure in the receiver 16, the percussive tool has a pumping means 17 comprised of a hollow cylinder 18 fixedly attached to the housing 9 of the pressure pulser, the hollow cylinder 18 having a plunger 19 capable of reciprocating together with the fluid displacer 10 of the pressure pulser and defining with the cylinder 18 a chamber 20 of variable volume, this chamber being in communication with the receiver 16 by means of a check valve 21 arranged at the outlet from this chamber 20 and a conduit 22. The check valve 21 permits the passage of air from the chamber 20 into the receiver 16 and prevents the return passage thereof. A through passage 23 is provided in the side wall of the cylinder 18 of the pumping means; the passage 23 may be either blocked by the side surface of the plunger or open to admit outside air into the chamber 20 depending on the position of the plunger 19. Another feature of the percussive tool illustrated in FIG. 4 is the provision of a discharge chamber 24 defined inside the hollow housing 9 which is in fact a cylinder closed on the two sides and separated from the working chamber 11 of the pressure pulser by the fluid displacer 10. The discharge chamber 24 is adapted to continuously communicate with the receiver 16 by way of a conduit 25. A rod 26 is further provided to impart reciprocations to the fluid displacer.

The heretofore described construction of the pumping means 17 is given by way of example. It stands to reason that it may be otherwise constructed. For example, it may be a separately driven light-duty compressor, or it may have the form of a compressed air cylinder provided with a pressure regulator.

The percussive tool of FIG. 4 operates when the drive means reciprocates the fluid displacer 10 of the pressure pulser. The plunger 19 of the pumping means effects reciprocations together with the fluid displacer 10. When the plunger 19 acts to compress the air contained in the chamber 20, the pressure therein is raised.

Under the action of the pressure differential in the chamber 20, the check valve 21 is caused to open whereby the compressed air is conveyed via the conduit 22 into the receiver 16. During the return stroke of the plunger 19 the check valve 21 acts to prevent the passage of air from the receiver 16 into the chamber 20 as a result of which an underpressure is produced in the chamber 20. The plunger 19 then opens the passage 23 to admit outside air therethrough into the chamber 20, whereafter the plunger 19 stops and starts again to compress the air in the chamber 20. The above described cycle of operation of the pumping means is then repeated. An overpressure is produced in the receiver 16 relative to the pressure of the outside air. When the pressure of air in the receiver 16 reaches a rated value, no more compressed air is admitted thereinto. Pressure in the receiver 16 depends on the extent to which the air in the chamber 20 is compressed and is determined by the rated parameters of the pumping means. It should be noted that in the intervals when the pumping means 17 does not deliver air into the receiver, the latter actually fails to consume energy. The energy spent for compressing the air in the chamber 20 fulfills a useful work (recuperates) during expansion. Therefore, the pumping means 17 serves to increase pressure in the receiver 16 to a rated value during the start up of the percussive tool and to compensate possible leaks, in other words to maintain a preselected pressure.

The discharge chamber 24 which continuously communicates with the receiver 16 provides for the reduction in the value of maximum loads exerted on the drive means of the pressure pulser, since the product of forces applied to the fluid displacer at an overpressure in this chamber is less than at a pressure equal to the pressure of the outside air.

In other respects the percussive tool with reference to FIG. 4 operates similarly to the one illustrated in FIG. 1, the difference residing only in that the machine of FIG. 4 features an increased specific power because its chambers are fed with a gaseous fluid (such as compressed air) of a higher pressure.

Figure 5:
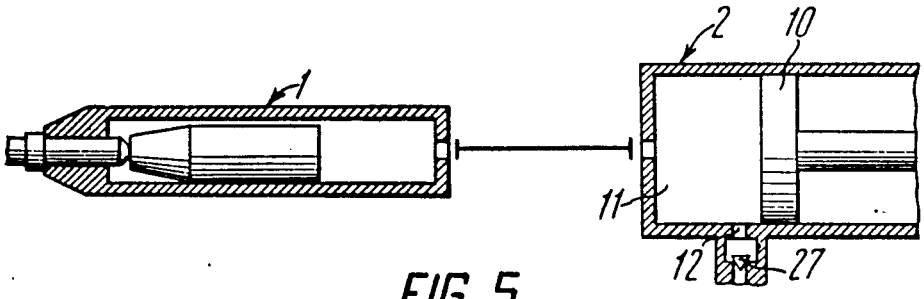
FIG. 5 shows one more modified form of the percussive tool embodying the present invention wherein there is provided a check valve to ensure a one-way passage of the gaseous fluid into the working chamber of the pressure pulser.

An embodiment of the percussive tool according to the invention with reference to FIG. 5 features a check valve 27 mounted at the inlet to the port 12 for feeding the gaseous fluid to the working chamber 11 of the pressure pulser. The check valve 27 is so arranged as to enable the passage of the gaseous fluid only in one direction, viz. inside the working chamber.

The operation of the modified form of the percussive tool according to FIG. 5 is peculiar in that the provision of the check valve 27 enables to increase the mean pressure in the working chamber 11 of the pressure pulser and, as a consequence, in the chambers of the percussion mechanism. This can be accounted by the fact that when the fluid displacer 10 in the course of reciprocations opens the port 12 for admitting the gaseous fluid into the working chamber 11, the value of pressure in this chamber is below than that of the outside (atmospheric) air, which causes a fresh portion of the outside air to enter the chamber 11 during each cycle. The subsequent compression of the air in the working chamber 11 results in that the check valve 27 prevents the escape of this air from the chamber 11. The one way passage of air into the working chamber 11 assures that, other conditions being equal, the mean pressure in this chamber will be higher than that in the same chamber of the percussive tool of FIG. 1. An increase in pressure in the working chamber 11 of the pressure pulser results in an increased specific power of the percussive tool. Otherwise, the percussive tool operates similarly to the one illustrated in FIG. 1.

The modifications of the percussive tool described heretofore within the spirit and scope of the invention enable, in contrast to the known similar machines, the following advantages: the utter simplicity of construction; higher specific power; higher efficiency; less noisy performance; and much wider applicability.

What is claimed is:

1. A percussive tool comprising a percussion mechanism having:

a hollow housing the interior of which is isolated from the outside, said housing having a working end;

a piston hammer arranged in the interior of said housing for reciprocation therein and separating the interior of said housing into two closed chambers of variable volume, said chambers including a first chamber and a second chamber, said first chamber communicating only with said second chamber, and said second chamber communicating with said first chamber and with a source of pressurized gaseous fluid;

a restrictor passage continuously freely intercommunicating said first and second chambers of said housing during the entire operation of the percussive tool; and a pressure pulser having:

a housing;

a source of gaseous fluid;

a fluid displacer arranged inside said housing of said pressure pulser and defining with the walls of said housing a working chamber;

communicating means for communicating said working chamber with said source of gaseous fluid, said communicating means including an opening provided in the side surface of the housing of the pressure pulser to communicate said working chamber with the source of gaseous fluid and also to be closed by the side surface of the fluid displacer depending on the position of the fluid displacer relative to the housing of the pressure pulser;

means for constantly communicating said working chamber with said second chamber of said percussion mechanism while said first chamber of said percussion mechanism remains closed except for the continuous free intercommunication between said first chamber and said second chamber provided by said restrictor passage; and driving means for driving said fluid displacer inside said housing of said pressure pulser for periodically varying the volume of said working chamber to transmit to said second chamber of said percussion mechanism a pulsed pressure under action of which reciprocations of said piston hammer are effected to deliver impacts to said working end of said hollow housing.

2. A percussive tool as defined in claim 1 wherein said restrictor passage is arranged in the body of said piston hammer.

3. A percussive tool as defined in claim 1 wherein said restrictor passage is arranged in said housing of said percussion hammer.

4. A percussive tool as defined in claim 1 wherein said restrictor passage is fashioned as a gap between said piston hammer and the walls of said housing of said percussion mechanism.

5. A percussive tool as defined in claim 1 wherein there is provided a receiver in the form of a separate closed chamber the volume of which is commensurate with the volume of said working chamber of said pressure pulser, said receiver being provided with a means for engaging it with and disengaging it from said working chamber.

6. A percussive tool as defined in claim 1 wherein said working chamber of said pressure pulser is adapted to alternately communicate with a pressurized source of gaseous fluid.

7. A percussive tool as defined in claim 1 wherein said working chamber of said pressure pulser is adapted to communicate with a source of gaseous fluid via a check valve to enable the passage of the gaseous fluid only into said working chamber.

8. A percussive tool as defined in claim 1 wherein, said pressure pulser is defined by a cylinder closed on two sides and having a fluid displacer in the form of a piston separating the interior of said cylinder into said working chamber and a discharge chamber, each of these chambers being connected to the source of pressurized gaseous fluid.

* * * * *